US007527262B2

(12) United States Patent
Beckstrom

(10) Patent No.: US 7,527,262 B2
(45) **Date of Patent: *May 5, 2009**

(54) OFFSETTING DEVICE FOR MAIL STACKERS

(75) Inventor: David W. Beckstrom, Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 475 days.

This patent is subject to a terminal disclaimer.

(21) Appl. No.: 11/300,121

(22) Filed: Dec. 14, 2005

(65) Prior Publication Data

US 2007/0132177 A1 Jun. 14, 2007

(51) Int. Cl.
*B65H 5/00* (2006.01)

(52) U.S. Cl. ..... 271/225; 271/184; 271/270; 271/202

(58) Field of Classification Search ..... 271/225, 271/270, 69, 202, 184, 285, 286; 198/418.8, 198/418.9, 419.1, 431
See application file for complete search history.

(56) References Cited

U.S. PATENT DOCUMENTS 3,486,426 A * 12/1969 McDonald ..... 198/418.8
3,636,828 A * 1/1972 Achelpohl ..... 198/418.8

* cited by examiner

*Primary Examiner*—David H Bollinger
(74) *Attorney, Agent, or Firm*—Steven J. Shapiro; Angelo N. Chaclas

(57) ABSTRACT

An offsetting device for use in a mail stacking system receiving a plurality of mailpieces at a receiving end for stacking the mailpieces along a line. The offsetting device has a nip to engage with the mailpieces, and a plurality of rollers to change the moving speed of the mailpiece so as to cause the aligning edge of the mailpiece to misalign with line so as to provide a break in a stack. Alternatively, the rollers can be used to align a mailpiece in relation to the line so as to true stacking.

12 Claims, 11 Drawing Sheets

OFFSETTING DEVICE FOR MAIL STACKERS

TECHNICAL FIELD

The present invention relates generally to a mail stacker and, more particularly, to a device for offsetting mailpieces in a conveyor stacker.

BACKGROUND OF THE INVENTION

A mass mailing system generally includes a mail inserting machine and a mail stacking machine. A mail inserting machine includes an envelope feeder for placing one envelope at a time in an inserting station, and a document accumulator to accumulate a plurality of documents into a stack before they are inserted into the envelope in the inserting station. Some mailing systems also include a folder for folding the stack of documents before the documents are moved into the inserting station for insertion. Some mailing systems also include a printer for printing an address on an envelope. After the filled envelopes are sealed and printed, they are stacked in a mail stacker so that the stacked mail can be collected and loaded by an operator into mail trays. Mass mailing systems are known in the art.

It would be desirable and advantageous to provide a method for indicating tray breaks so as to allow the operator to transfer the mail into a tray according the tray breaks. Furthermore, when the produced mail is sequenced for sorting, it would also be desirable to provide zip breaks on the stacked mail while they are stacked in the stacker. Breaks are sometimes used for quality control purposes, allowing for periodic operator inspection.

SUMMARY OF THE INVENTION

The present invention uses an inline device to offset one or more mailpieces to indicate a mail break in the mail stack while the mailpieces are stacked on a conveyor stacker. When the mailpieces are conveyed from a mail inserting machine or a printer onto a conveyor stacker for stacking, they are separately moved at a first moving speed in a first moving direction. On the conveyor stacker, mailpieces are moved at a second moving speed in a second moving direction.

In a first embodiment of the present invention, the second moving direction is substantially perpendicular to the first moving direction. If the first moving speed is substantially constant, then the leading edges of the mailpieces moved from the inserting machine or printer onto the conveyor stacker are aligned with each other to form a stack. The stacked mailpieces are aligned along a registration line without being pushed against a physical registration barrier. The mail-offsetting device, according to the first embodiment of the present invention, changes the first moving speed of the mailpiece to be offset. As such, the leading edge of the offset mailpiece is not aligned with the registration line. The offset mailpiece can be used to indicate a tray break, a zip break or a break for other purposes. The mail-offsetting device is operatively connected to a control module to receive a signal for effecting such an offset.

In a second embodiment of the present invention, the conveyor stacker is also disposed inline with the mail-offsetting device. The second moving direction is substantially the same as the first moving direction. As such, the side edges of the mailpieces moved from the inserting machine or printer onto the conveyor stacker are aligned with each other to form a stack. The mail-offsetting device, according to the second embodiment of the present invention, skews one or more mailpieces as they are moved onto the conveyor stacker. The skewed mailpieces can be used to indicate a tray break, a zip break or a break for other purposes.

In a third embodiment of the present invention, the offsetting device is used to straighten a mail stack if the mailpieces are not aligned when they are moved from the inserting machine or printer onto the conveyor stacker.

DETAILED DESCRIPTION OF THE INVENTION

Figure 1A:
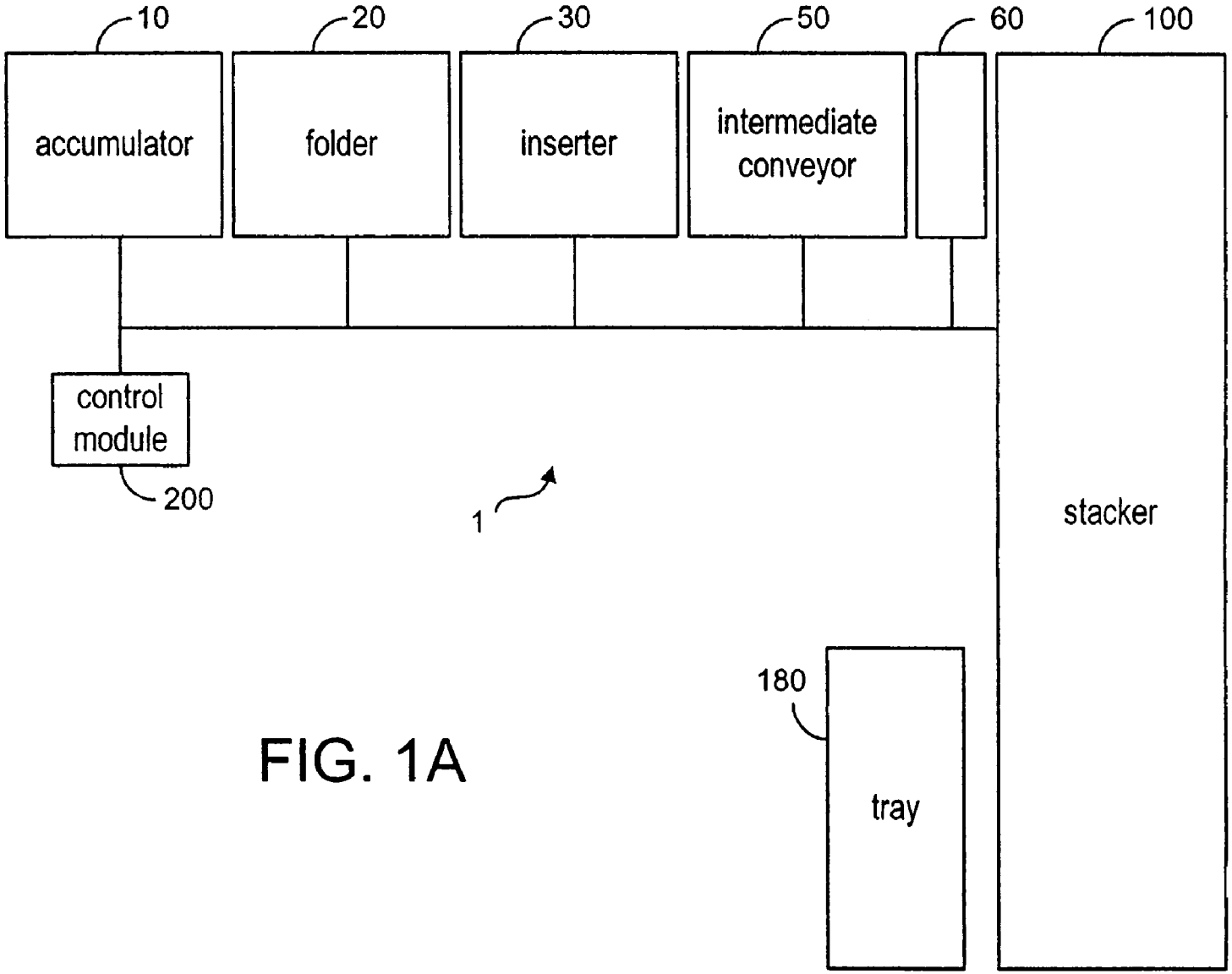
FIG. 1*a* is a schematic representation of a mass mailing system having a mail offsetting device, according to the present invention.
Figure 1B:
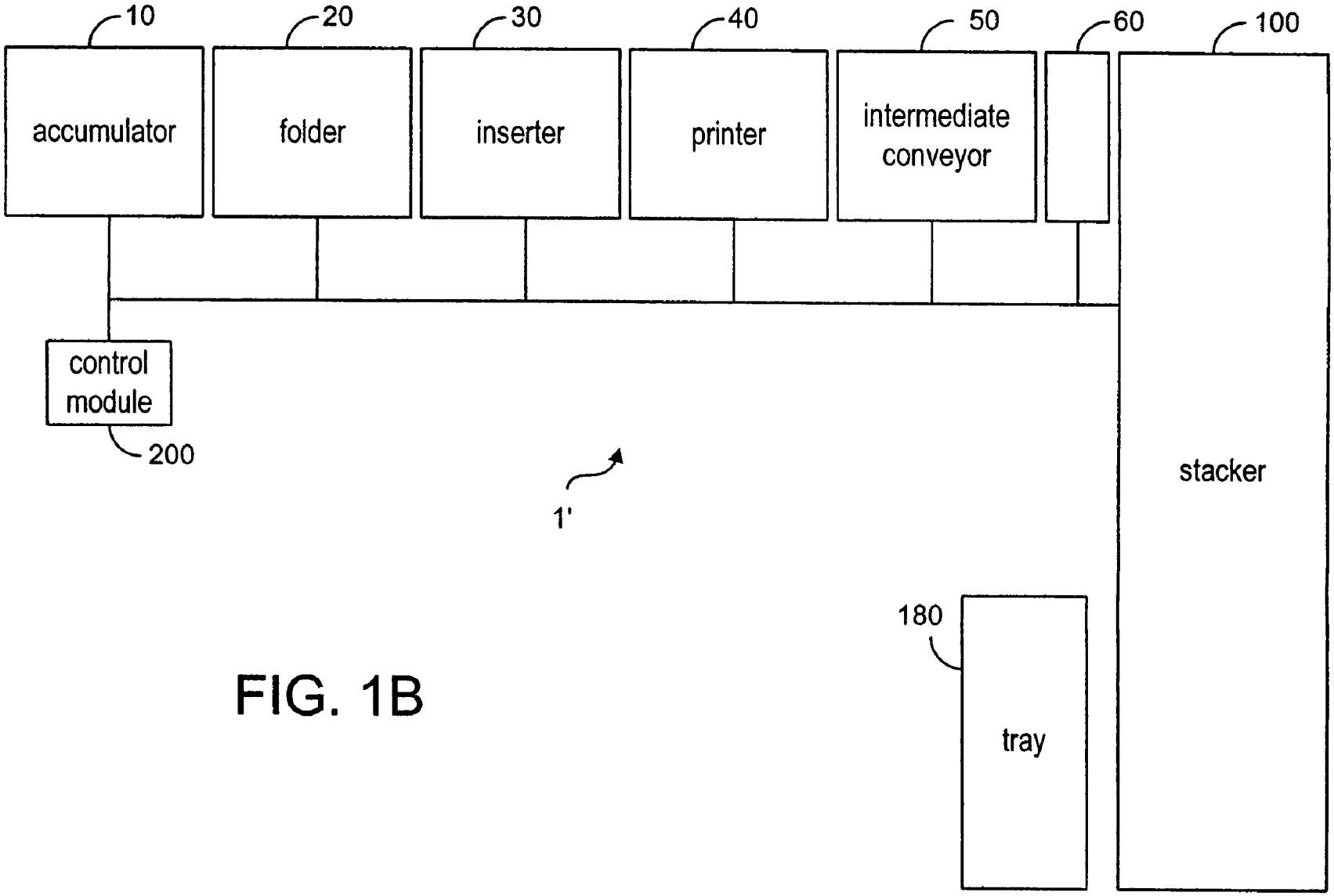
FIG. 1*b* is a schematic representation of a mass mailing system including a printer and a mail offsetting device, according to the present invention.

A typical mass mailing system is shown in FIGS. 1*a* and 1*b*. As shown, the mailing system 1 includes an accumulator 10 to accumulate a plurality of documents into a stack; a folder 20 to fold a stack of documents before moving the documents are moved into an inserter 30 to be inserted into a receiving envelope. The filled envelopes are then transported by an intermediate conveyor 50 onto a stacker 100 for stacking. The stacked mailpieces are collected and loaded by an operator to a mail tray 180. The operations of such a mass mailing system are known in the art. According to the present invention, a mail offsetting module or device 60 is positioned in relationship with the stacker 100 for producing mail breaks in the stacked mail. The mailing system 1 also has a central control module 200, operatively connected to various components of the mailing system in order to coordinate the operations in those components. The control module 200 can be used to send a signal to the offsetting device 60 in order to make a mail break. A computer software in the control module 200 can be programmed to schedule a tray break according to a size of the mail tray, for example. The computer software can be programmed to send a signal to the offsetting device 200 when a change in the zipcode occurs in the mail that is sequenced for pre-sorting. A mail break can also be scheduled for quality control purposes, allowing an operator to inspect the mail periodically, for example.

In the mass mailing system 1' as shown in FIG. 1*b*, a printer 40 is also used to print an address or other information on the filled envelope before the filled envelope is transported to the stacker 100.

Figure 2:
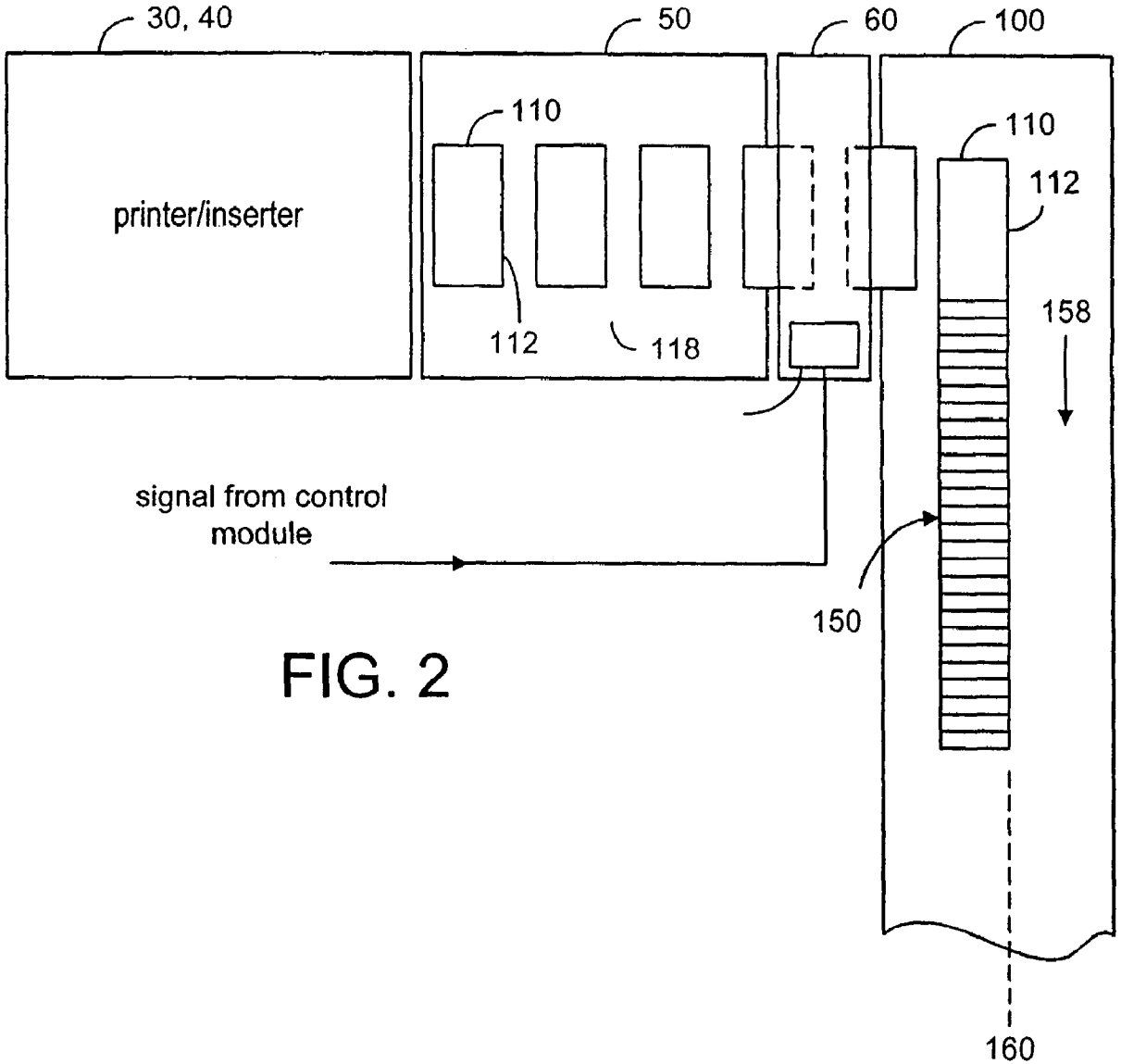
FIG. 2 is a schematic representation showing mailpieces being stacked on a conveyor stacker.

In one embodiment of the present invention, the intermediate conveyor 50 and the stacker 100 form a two-stage, right-angle stacker. The stacker 100 can be a conveyor stacker for moving the mailpieces by a conveyor belt. As can be seen in FIG. 2, the filled envelopes or mailpieces 110 are moved out of the inserter 30 or printer 40 onto the intermediate conveyor 50. The mailpieces 100 are moved in a first moving direction 118 toward the conveyor stacker 100 through the offsetting device 60. The offsetting device 60 has a movement mechanism 68 to offset a mailpiece. The conveyor stacker 100 moves the mailpieces in a second moving direction 158, which is substantially perpendicular to the first moving direction 118. If the moving speed of the mailpieces 110 along the moving direction 118 is reasonably constant, then the leading edge 112 of each mailpiece 110 is substantially aligned with the leading edge of the other mailpieces in the stack 150. As such, when the mailpieces are stacked on the conveyor stacker 100, they are aligned with a registration line 160 without being urged to line up against a registration wall or the like.

Figure 3:
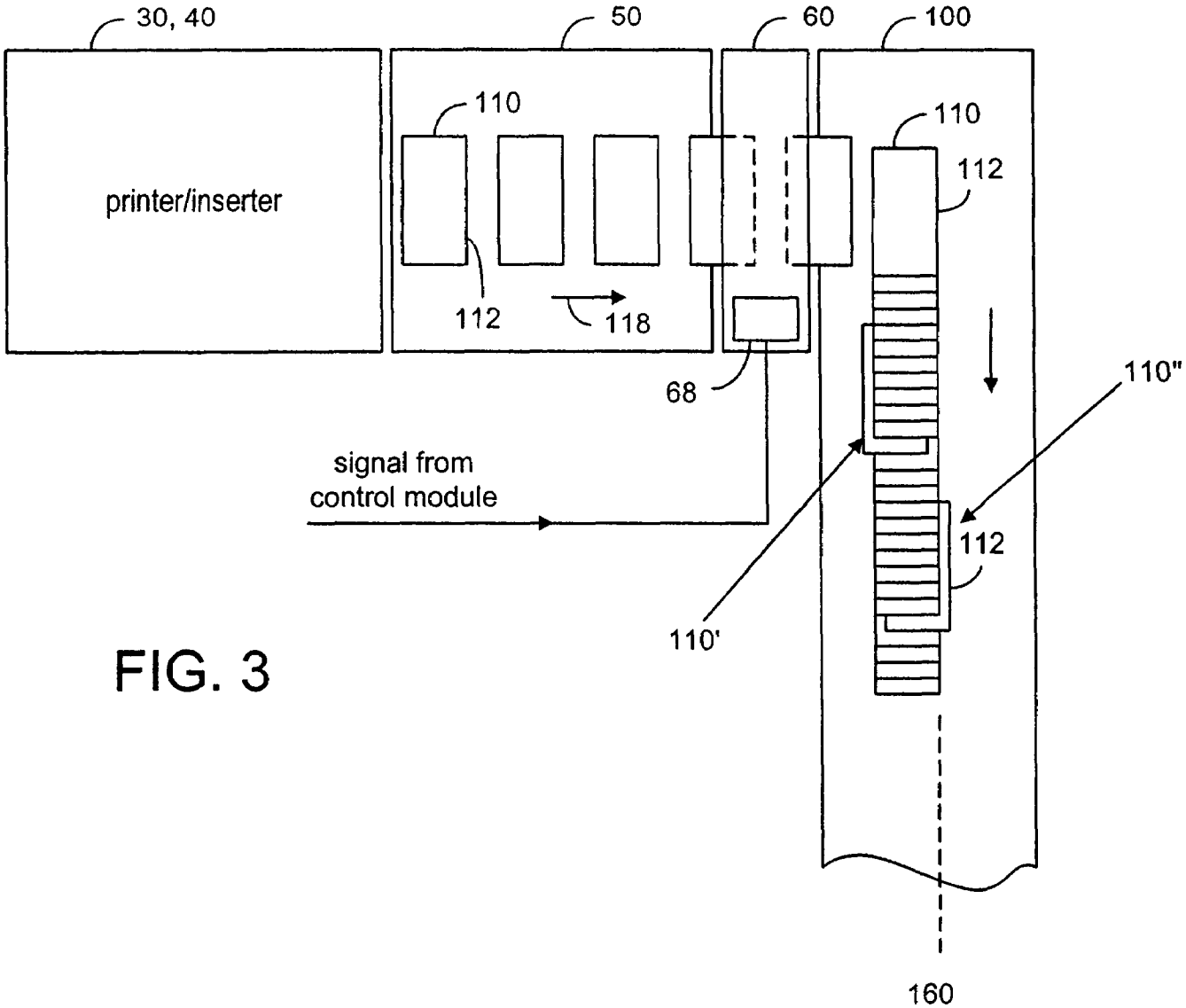
FIG. 3 is a schematic representation showing one or more mailpieces being offset to indicate mail breaks.

When a mail break is scheduled or desired, a signal is sent to the offsetting device 60 in order to activate the movement mechanism 68, as depicted in FIG. 3. The movement mechanism 68 can cause the moving speed of a mailpiece along the moving direction 118 to increase or decrease. If the offsetting device 60 increases the moving speed of the mailpiece 110", the leading edge 112 of the mailpieces 110" is moved beyond the registration line 160 when the mailpiece 110" is stacked. In this case, the offsetting device adds a speed component to the moving speed of the mailpiece 110" along the moving direction 118. If the offsetting device 60 introduces a speed component opposite to the moving direction 118, it decreases the moving speed of the mailpiece 110', causing the leading edge of the mailpiece 110' to fall behind the registration line 160. In either way, each of the offset mailpieces 110', 110" can be used to indicate a zip break or a tray break, for example.

Figure 4:
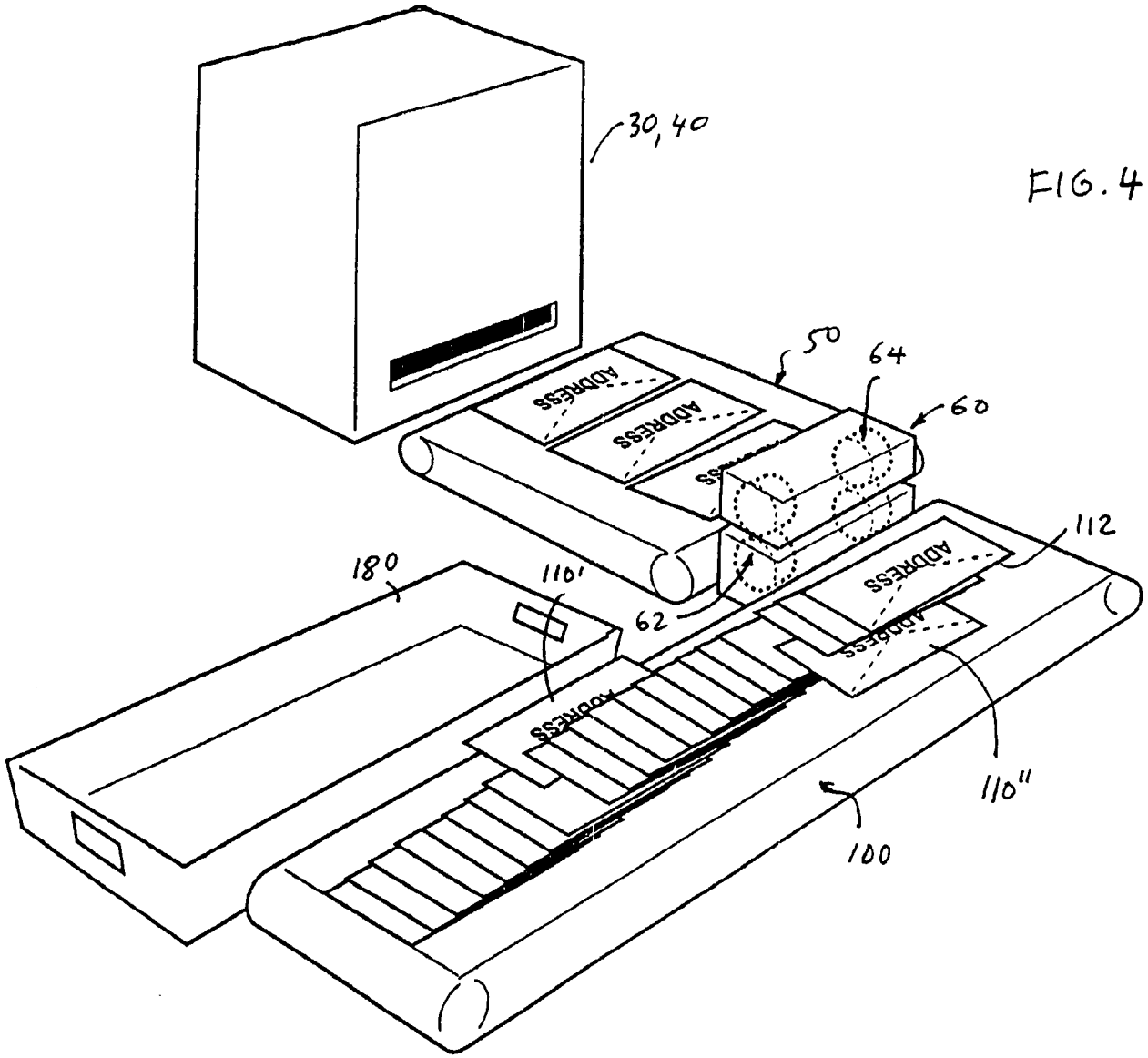
FIG. 4 is a schematic representation showing a perspective view of a two-stage, right-angle stacker with an offsetting module.
Figure 8A:
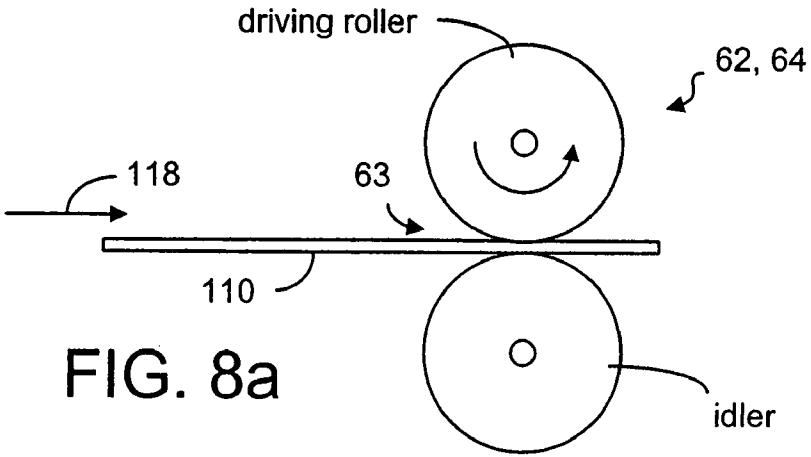
FIG. 8*a* is a schematic representation showing how the offsetting module increases the moving speed of a passing mailpiece.
Figure 8B:
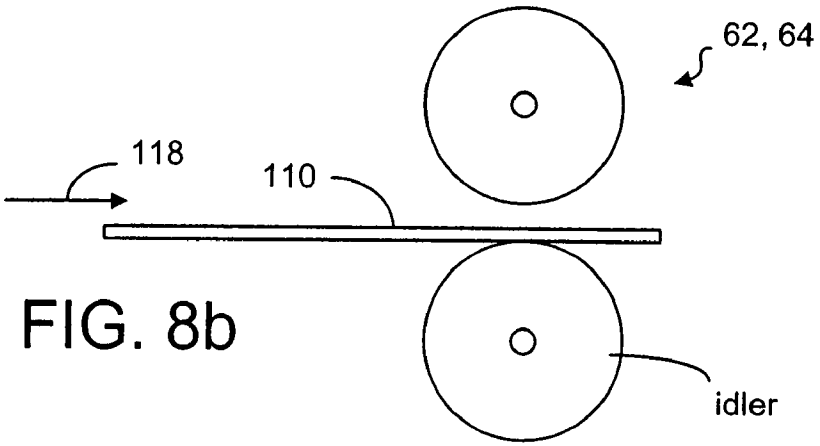
FIG. 8*b* is a schematic representation showing the offsetting module being effectively disengaged from a passing mailpiece.
Figure 8C:
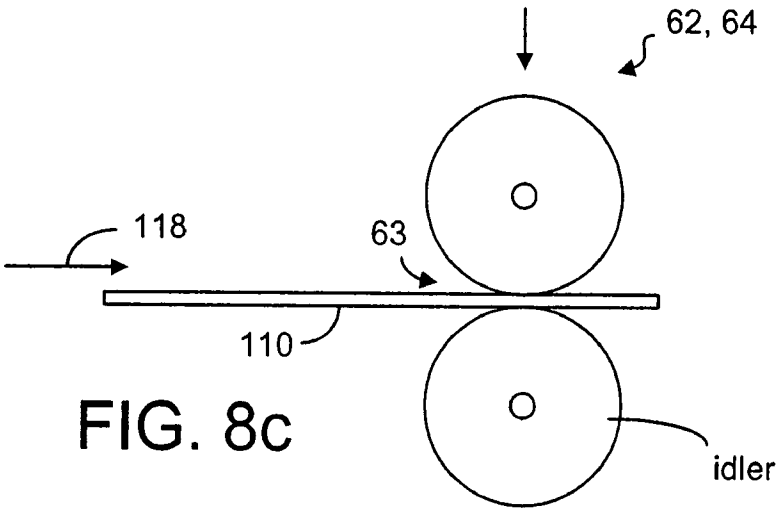
FIG. 8*c* is a schematic representation showing how the offsetting module decreases the moving speed of a passing mailpiece.

FIG. 4 shows a perspective view of the two-stage, right-angle stacker 50, 100 in relation to the off-setting device 60. As an example, the offsetting device 60 comprises a first roller pair 62 and a second roller pair 64. The rollers are adapted to engage with the movement mechanism 68 (not shown) in order to increase or decrease the moving speed of a mailpiece passing through the nip formed by the rollers, as shown in FIGS. 8*a* and 8*c*. The movement mechanism 68 can be a driving motor to some rollers to rotate, or a relay to increase the friction between the rollers and the passing mailpiece, for example.

Figure 5:
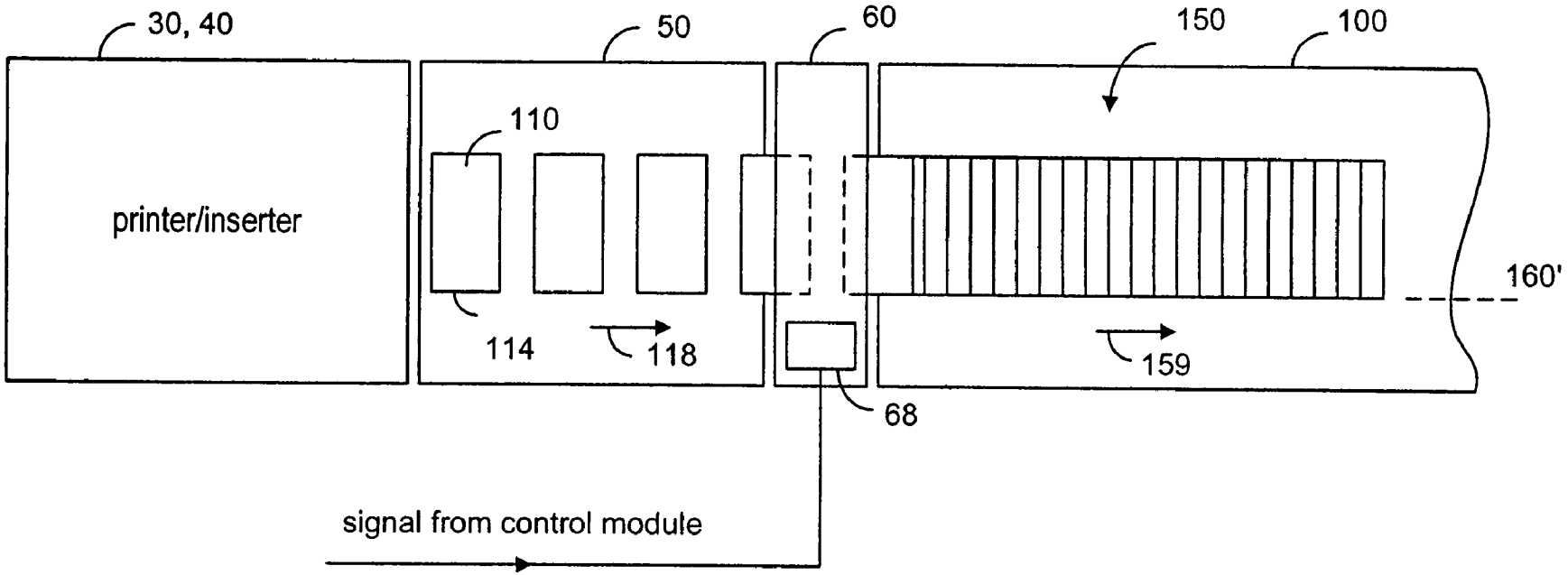
FIG. 5 is a schematic representation showing mailpieces being stacked on an in-line stacker.

In another embodiment of the present invention, the intermediate conveyor 50 and the conveyor stacker 100 form a two-stage, in-line stacker. As can be seen in FIG. 5, the mailpieces 110 in the intermediate conveyor 50 are moved in a first moving direction 118 toward the conveyor stacker 100 through the offsetting device 60. The conveyor stacker 100 moves the mailpieces in a third moving direction 159, which is substantially the same as the first moving direction 118. As such, when the mailpieces are stacked on the conveyor stacker 100, the side edge 114 of each mailpiece 110 is aligned with a registration line 160'.

Figure 6:
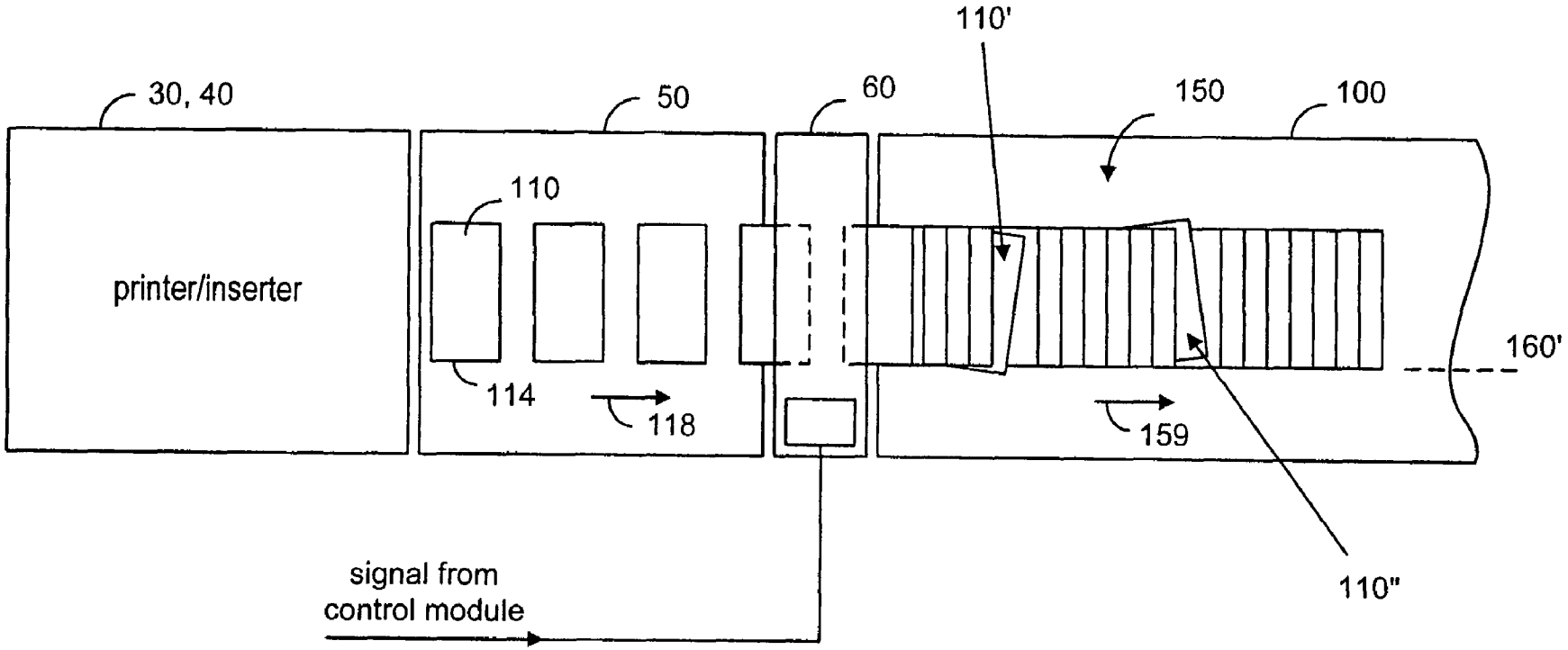
FIG. 6 is a schematic representation showing one or more mailpieces being skewed to indicate mail breaks.

When a mail break is desirable, a signal is sent to the offsetting device 60 in order to activate the movement mechanism 68. The movement mechanism 68 can cause the moving speed of a mailpiece along the moving direction 118 to increase or decrease unevenly so as to skew the mailpiece passing through the offsetting device 60. As shown in FIG. 6, the mailpiece 110' and the mailpiece 110" are skewed in different directions. Each of the skewed mailpieces 110', 110" can be used to indicate a zip break or a tray break, for example.

Figure 7:
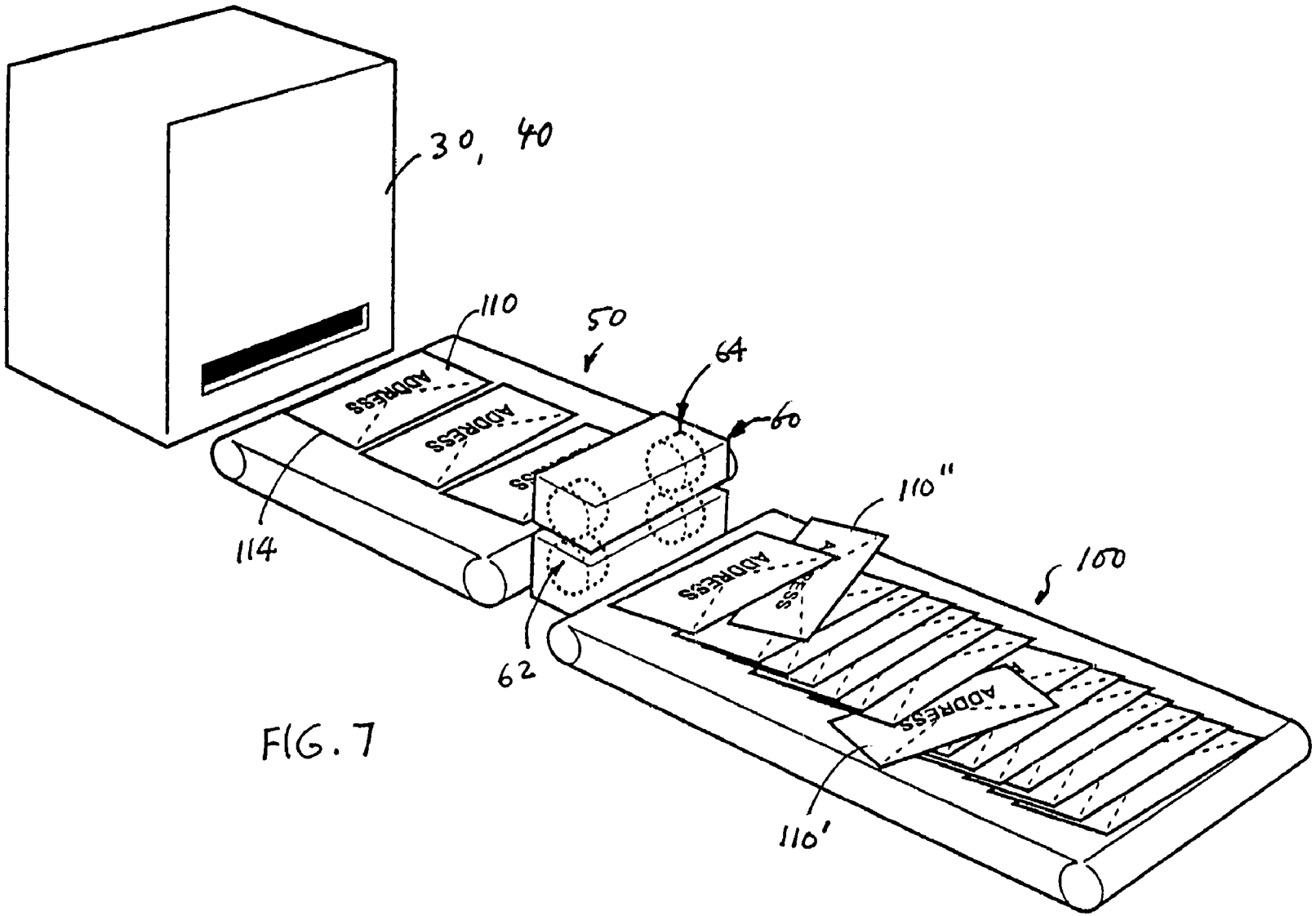
FIG. 7 is a schematic representation showing a perspective view of a two-stage, in-line stacker with an offsetting module.

FIG. 7 shows a perspective view of the two-stage, in-line stacker 50, 100 in relation to the offsetting device 60. In this embodiment, the roller pairs 62, 64 are independent of each other so as to rotate the mailpiece in a clockwise direction or in a counter-clockwise direction.

It should be noted that there are many different ways to increase or decrease the moving speed of a mailpiece in the offsetting device 60 in order to create a mail break. For example, each of the roller pairs 62, 64 has a driving roller and an idler. When the mailpiece 110 is received into the nip 63 formed by the driving roller and the idler, the moving speed of the mailpiece 110 can be increased by the driving roller, as shown in FIG. 8*a*. The driving roller is operatively engaged with a driving motor, for example. When a mail break is not scheduled or desired, the driving roller is disengaged from the driving motor so it serves as an idler, for example. Alternatively, the driving roller can be engaged with a driving motor at all times but it rotates at different speeds in order to change the moving speed of a passing mailpiece. In another embodiment, when a break is not desired, the driving roller is moved away from the idler so as not to introduce a frictional force between the driving roller and the passing mailpiece, as shown in FIG. 8*b*. In order to reduce the moving speed of the passing mailpiece, it is possible to tighten the nip 63 for a short period of time, as shown in FIG. 8*c*.

Figure 9:
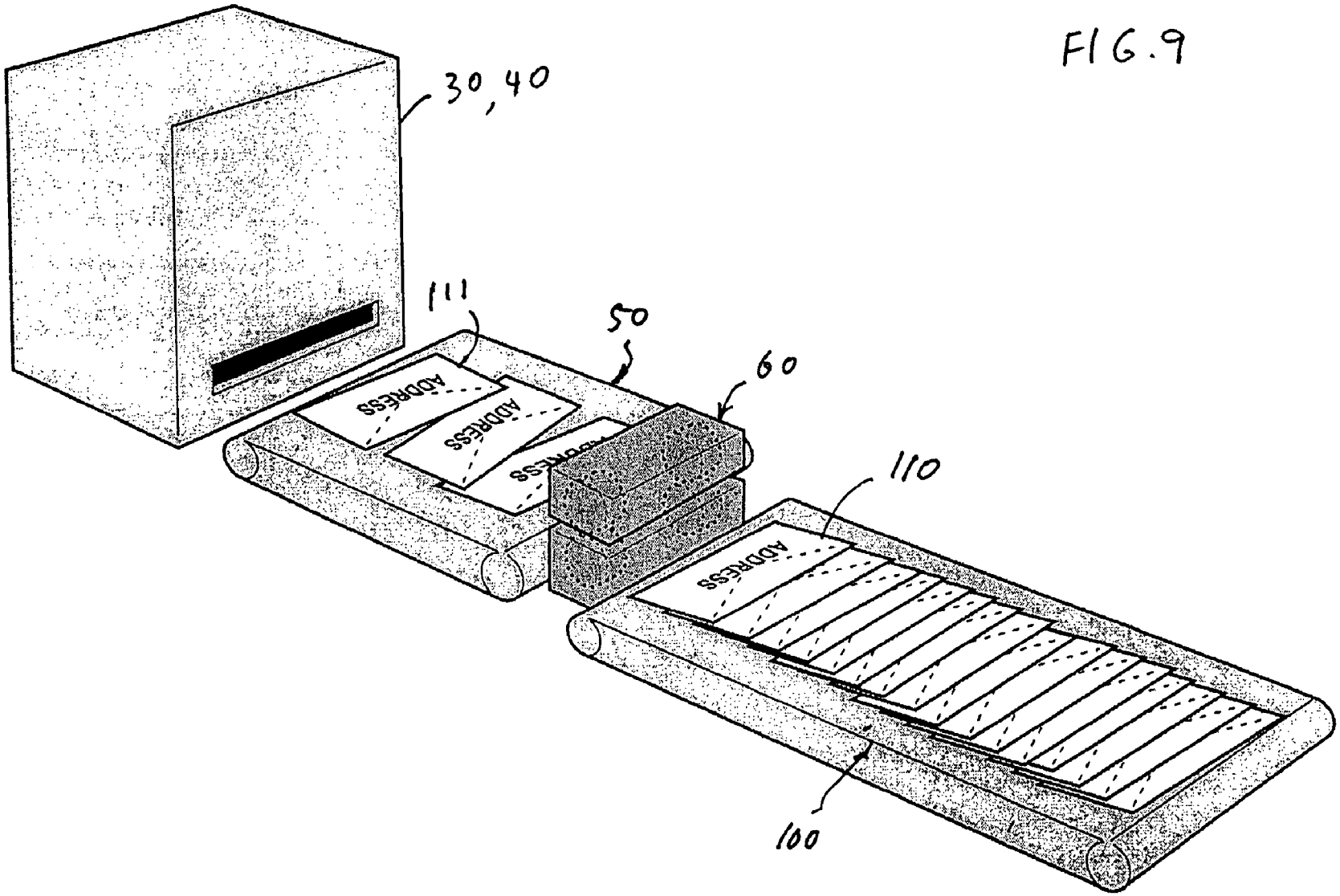
FIG. 9 is a schematic representation showing a perspective view of a two-stage in-line stacker wherein the offsetting module is used to align the mailpieces.
Figure 10:
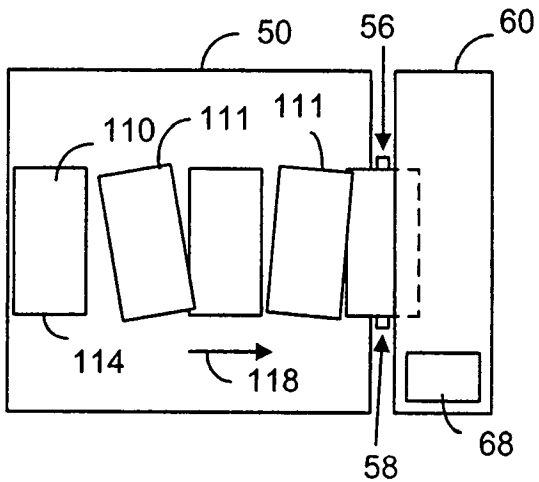
FIG. 10 is a schematic representation showing a plurality of sensing devices for detecting skewed mailpieces.

The offsetting device 60 can be used to align the mailpieces if the mailpieces moved from the inserter 30 or printer 40 onto the intermediate conveyor 50 are not aligned. As shown in FIG. 9, some of the mailpieces 111 are skewed when they are moved onto the intermediate conveyor 50. It is possible to use the roller pairs 62, 64 to adjust those mailpieces so that when they are moved onto the conveyor stacker 100, they are aligned with each other. In order to detect the skewed mailpieces 111 on the intermediate conveyor 50, a number of sensing devices, such as photodectors 56, 58, can be placed between the intermediate conveyor 50 and the offsetting device 60, as shown in FIG. 10.

Figure 11:
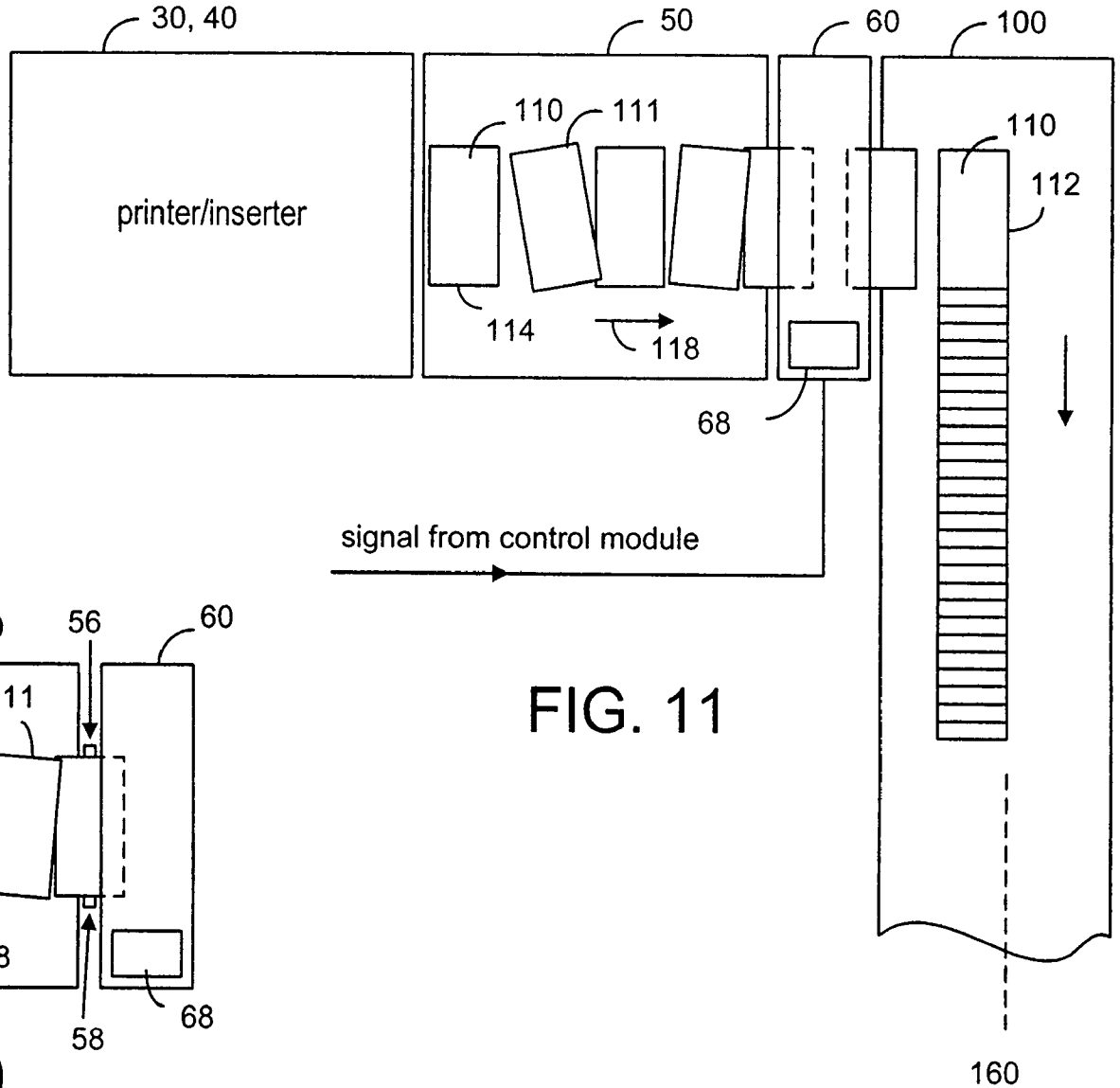
FIG. 11 is a schematic representation showing a two-stage, right-angle stacker wherein the offsetting module is used to align the mailpieces.

It should be noted that the offsetting device 60 can also be used to true stacking in a right-angle stacking device as shown in FIG. 11.

Although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A method for adjusting a mail stack in a stacker, the mail stack comprising a plurality of mailpieces, each mailpiece having an aligning edge, wherein the mailpieces are sequentially moved into the stacker at a moving speed so that the aligning edges of the mailpieces are substantially aligned along a line for stacking, said method comprising the steps of:

selecting one or more mailpieces before the mailpieces are stacked; and changing the moving speed of said selected mailpiece so as to cause the aligning edge of said selected mailpiece to change in relation to the line and wherein said changing step adds a speed component in the moving speed of the selected mailpiece, the added speed component having a speed direction substantially the same as the first moving direction so as to increase the moving speed.

2. The method of claim 1, wherein the mailpieces are moved into the stacker along a first moving direction, each mailpiece having a leading edge, and the stacker moves the mailpieces in the stacker along a second moving direction for stacking, the second direction substantially perpendicular to the first moving direction, and wherein the aligning edge is the leading edge.

3. The method of claim 1, wherein said changing step causes the aligning edge of each of said selected mailpieces to misalign with the line so as to provide a break in the mail stack.

4. The method of claim 1, wherein the aligned edge of each of said selected mailpieces is out-alignment with the line and said changing step causes the aligning edge to align with the line.

5. A mail stacking system adapted to receive a plurality of mailpieces at a receiving end for stacking the mailpieces into a stack, each mailpiece having an aligning edge, wherein the mailpieces are sequentially moved into the stacking system at a moving speed so that the aligning edges of the mailpieces are substantially aligned along a line, said stacking system comprising:

a moving mechanism for moving the mailpieces received into the stacking system away from the receiving end for stacking; and a speed changing mechanism, positioned in relationship with the receiving end, for changing the moving speed of at least one of the mailpieces received at the receiving end so as to cause a change in the aligning edge of said at least one mailpiece in relation to the line and wherein the speed changing mechanism comprises means for adding a speed component in the moving speed of the selected mailpiece, the added speed component having a speed direction substantially the same as the first moving direction so as to increase the moving speed.

6. The mail stacking system of claim 5, wherein the mailpieces are moved into the stacker along a first moving direction, each mailpiece having a leading edge, and the stacker moves the mailpieces in the stacker along a second moving direction for stacking, the second direction substantially perpendicular to the first moving direction, and wherein the aligning edge is the leading edge.

7. The stacking system of claim 5, wherein the speed changing mechanism causes the aligning edge of each of said selected mailpieces to misalign with the line so as to provide a break in the mail stack.

8. The stacking system of claim 5, wherein the aligned edge of each of said selected mailpieces is out-alignment with the line and the speed changing mechanism causes the aligning edge to align with line.

9. The stacking system of claim 8, further comprising sensing means for detecting the out-alignment of the mailpieces.

10. An offsetting device for use in a mail stacking system, the mail stacking system adapted to receive a plurality of mailpieces at a receiving end for stacking the mailpieces into a stack, each mailpiece having an aligning edge, wherein the mailpieces are sequentially moved into the stacking system at a first moving speed so that the aligning edges of the mailpieces are substantially aligned along a line, said offsetting device comprising:

a nip, positioned in relationship with the receiving end, for engaging with at least one of the mailpieces; and a speed changing mechanism, cooperating with the nip, for changing the first moving speed of said at least one mailpiece to a second moving speed so as to cause the aligning edge of said at least one mailpiece to change in relation to the line.

11. The offsetting device of claim 10, wherein the speed changing mechanism cause the aligning edge of said at least one mailpiece to misalign with the line so as to provide a break in the stack.

12. The offsetting device of claim 11, wherein said speed changing mechanism includes a control module and a motor, said nip is defined between first and second rollers, and one of said first and second rollers is driven by said motor, and wherein during a first mode of operation said control module controls said motor to drive said one of said first and second rollers such that said at least one of said mailpieces is engaged between the first and second rollers in the nip and driven at the first moving speed and during a second mode of operation said control module controls said motor to drive said one of said first and second rollers such that said at least one of said mailpieces is engaged between the first and second rollers in the nip and driven at the second moving speed.

* * * * *